United States Patent [19]

Underhill

[11] Patent Number: 4,640,385

[45] Date of Patent: Feb. 3, 1987

[54] PORTABLE SCAFFOLDING

[76] Inventor: Philip O. Underhill, 5747 Newland Rd., Paradise, Calif. 95969

[21] Appl. No.: 747,557

[22] Filed: Jun. 21, 1985

[51] Int. Cl.[4] ..... E04G 1/32

[52] U.S. Cl. ..... 182/113; 182/181; 182/224; 182/214

[58] Field of Search ..... 182/113, 214, 224, 230, 182/181, 117, 184; 248/165, 166, 168, 151, 439, 163.1

[56] References Cited

U.S. PATENT DOCUMENTS

| | | | |
|---|---|---|---|
| 798,371 | 8/1905 | Ward | 248/168 |
| 921,431 | 5/1909 | Miller | 182/230 |
| 2,272,957 | 2/1942 | Walp | 182/224 |
| 2,549,212 | 4/1951 | Lane | 182/181 |
| 2,639,853 | 5/1953 | Pierce | 182/214 |
| 2,666,608 | 1/1954 | Holm | 248/163.1 |
| 2,896,891 | 7/1959 | Ernst | 248/168 |
| 2,966,957 | 1/1961 | Ireland | 182/224 |
| 3,472,338 | 10/1969 | Weidman | 182/230 |
| 3,595,510 | 7/1971 | Hutchinson | 182/113 |
| 4,331,217 | 5/1982 | Stecklow | 182/214 |

FOREIGN PATENT DOCUMENTS

| | | | |
|---|---|---|---|
| 237205 | 2/1960 | Australia | 182/230 |
| 741706 | 8/1966 | Canada | 182/224 |

*Primary Examiner*—Reinaldo P. Machado
*Assistant Examiner*—Alvin Chin-Shue

[57] ABSTRACT

There is provided portable scaffolding units useful in pairs or more having an angled main leg attached to a walkway support T-brace leaning against the wall or surface being worked. The T-brace rests against the work surface held with no-slip pliable ribbed facing and by an adjustible nailer. The positioning of a raised work walkway is side supported by angled braces affixed to both sides of the walkway support T-brace. The main leg and the angle braces are both adjustible in length and affixed with leveling feet for holding the structure firmly on uneven or soft ground. Safety brackets are supplied to hold a safety rail at a sufficiently high position above a plank walkway to prevent step-back accidents.

6 Claims, 13 Drawing Figures

PORTABLE SCAFFOLDING

BACKGROUND OF THE INVENTION

This invention relates to scaffolding structures which are adjustible for both height and uneven ground surfaces. The present invention is particularly directed towards being portable through simple disassembly mechanics and interfitting parts.

The patents seen representing the prior art indicate awareness for the need of scaffolding both adjustible and portable. A U.S. Pat. No. 71,960, issued to J. E. Bliss on Dec. 10, of 1876, shows a single-leg lean support structure with a height increasing locking leg device. Another older patent issued to Lamb and Livings on Jan. 14, of 1868, U.S. Pat. No. 73,346, illustrates a single leg X-braced scaffold. These two early patents do not show any provisions for side bracing nor for uneven ground positioning of a leveled walkway.

In a later patent dated Sept. 23, 1952, U.S. Pat. No. 2,611,570, J. J. Kroll the inventor, a novel framework which does take into consideration side support and uneven ground positioning is shown. It was developed as a mail box stand and does not appear to be useful for other purposes. A U.S. Pat. No. 2,812,220, with J. H. King the holder, dated Nov. 5, 1957, illustrates a telescoping tubular scaffolding with a triangle top brace and U.S. Pat. No. 2,666,608, C. E. Holm, Jan. 19, 1954, is also a telescoping tubular structure.

The F. P. Fedoryk U.S. Pat. No. 3,213,965, dated Oct. 26, 1965, discloses a portable lean-to scaffolding. No angled or side supports are seen. A second U.S. Pat. No. 3,425,510, Feb. 4, 1969, issued to Mr. Fedoryk shows a more complicated structure of his lean-to scaffolding. U.S. Pat. No. 3,586,128, granted to R. E. Sandberg on June 22, 1971, illustrates a simple staging structure again with no side bracing means, and the patent to Erickson on Sept. 23, 1975, U.S. Pat. No. 3,906,872, does use angle braces for corner shelf supports but not in a scaffold.

In the prior art seen, there does not seem to be any provisions for needed side support bracing or for cooperative adjustability in the supporting structures to maintain a walkway in a leveled position when the scaffolding is used on uneven ground surfaces.

OBJECTS OF THE INVENTION

Therefore, it is a principle object of the present invention to provide a scaffolding with interfitting parts which can be easily disassembled for portability.

A further object of this invention is to provide a scaffolding having adjustible side bracing.

A still further object of the invention is to provide units of adjustible single legged scaffolding useful in pairs or more for positioning a raised leveled walkway along a wall or building work area.

Another object of this invention is to supply a safe and firmly secured raised work walkway for working up the side of a structure through presurized angling of the support leg and side braces against that structure and having means for fixing the support assemblage temporarily to the wall of said structure.

A further object is to provide workers with a safety rail sufficiently positioned above the work walkway to prevent an accidental step-back fall.

Other objects and the many advantages of this invention will become obvious and better understood with a reading of the included specification in relationship to the drawings and the numbered parts thereon.

A BRIEF DESCRIPTION OF THE DRAWINGS

DESCRIPTION OF THE PREFERRED EMBODIMENT

Figure 1:
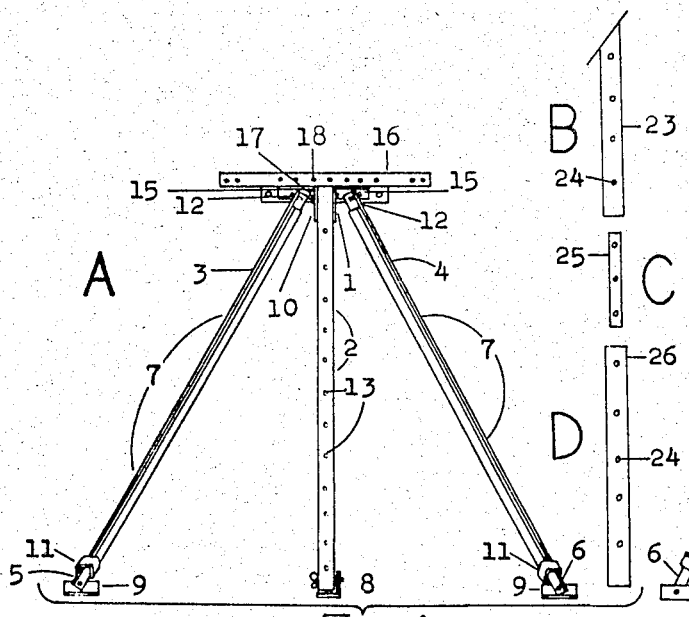
FIG. 1 shows the scaffolding from the support leg side at A with extensions for the leg illustrated at B and D; and the leg extender insert shown at C. Angled side braces can be seen attached to fittings on the T bar supports.
Figure 2:
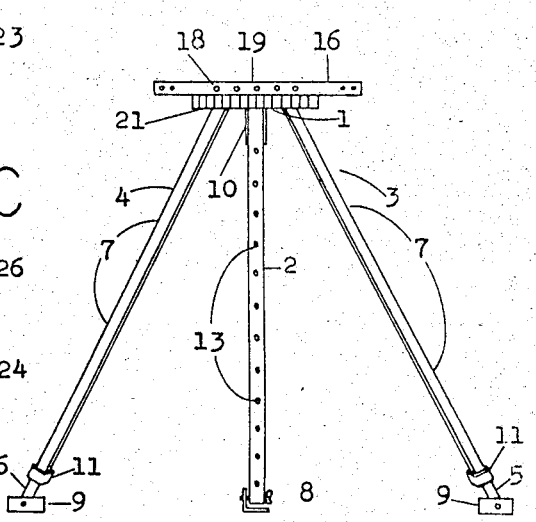
FIG. 2 is a view of the scaffolding from the house side showing the front edge of the T bar affixed with a pliable ribbing to prevent slipping. The adjustable nailer is shown bolted to the top of of the T bar above the ribbed facing.
Figure 3:
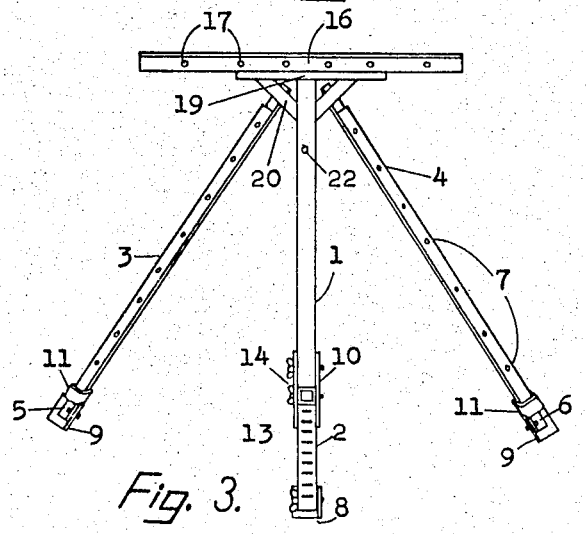
FIG. 3 shows a view of the scaffold assemblage looking down from the top. The position of the nailer and the adjustment holes is illustrated.
Figure 4:
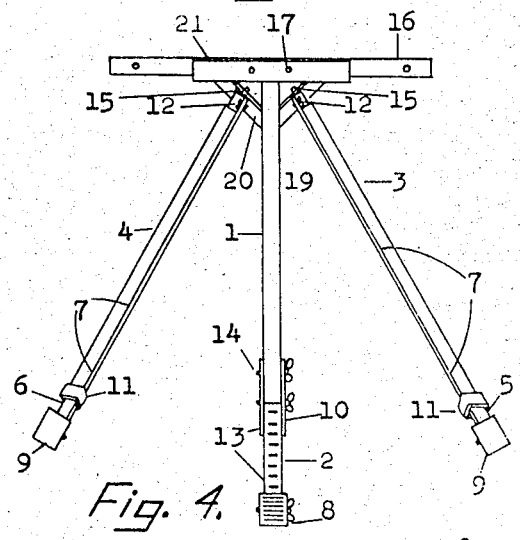
FIG. 4 is the scaffolding as it would be appear from the ground up. Ribbed padding on the main leg leveler foot is shown and the bottoms of the angle support braces leveler feet can be seen.

Referring now to the drawings, at FIG. 1, the assembled scaffolding A has main support leg 2 affixed to walkway support 1 (see FIG. 5 side view) by main leg attach brackets 10 retained there by bolts and wing nuts 14 seen in a top view at FIG. 3. Extendable side braces 3 and 4 are removably attached to T bar 19 at angled T brace supports 20 as lateral bracing for walkway support 1. The angled side braces 3 and 4 have extension mechanics in that interfitted parallel leg sections 5 for 3 and 6 for 4 retained in a set position by wing-nut bolts like 14 using brace adjust holes 7 can slide down 3 and 4 through brace extender slide retainers 11 to better position the brace leveler foot 9 on uneven ground or for additional height. Main support leg 2 can also be lengthened by removal of leveler foot 8 and bolting on extension section 23 (illustrated at FIG. 1B) held by leg extender insert 25 (shown at FIG. 1C). Additional lengths may be added by using a second insert 25 and bolting on a second extension 26 thereto as shown in FIG. 1D. The main support leg adjustment holes 13 and the extension adjust holes 24 match for bolting purposes. A longer insert 25 can be used as a main leg extender by removal of leveler foot 8 and affixing same to lengthened extender insert 25 then bolting insert 25 to a desired position using leg adjust holes 13 in main support leg 2. For additional structural firmness, adjustible nailer 16 is bolted to the top of T bar 19 and can be nailed to the work surface through nailer attach holes 18. To prevent slipping when nailer 19 is not used, the wall-facing edge of T bar 19 is affixed with pliable ribbed facing 21.

Figure 9:
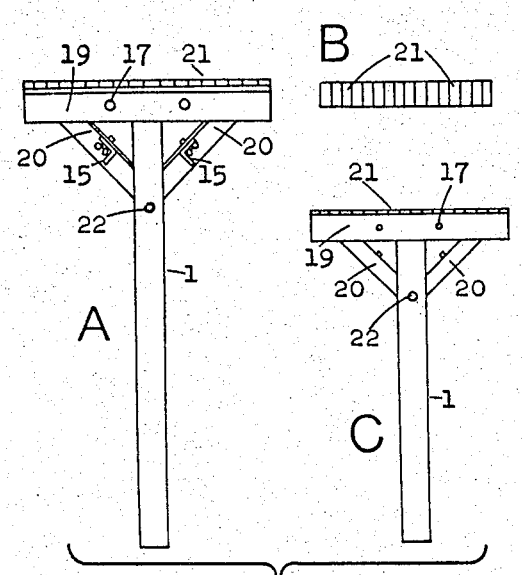
FIG. 9 illustrates the walkway support with T bar end from an underneath view at A, showing the ribbed end of the T bar at B, and in a view from the top at C.
Figure 8:
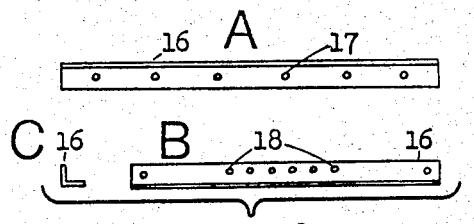
FIG. 8 is a drawing of the adjustible nailer in a top view at A, in a side view at B, and illustrating the angle iron shape in an end view at C.
Figure 10:
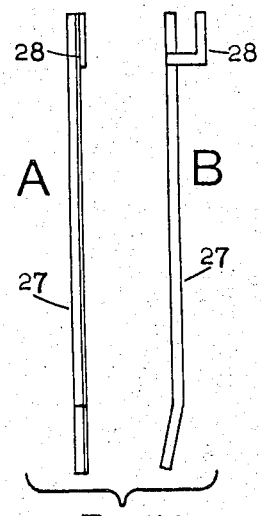
FIG. 10 is an enlargement of the safety bracket in a edge view at A and in a side view at B.

For a better understanding of the useful parts in this scaffold, FIG. 9 at A shows walkway support 1 in an upward view from below. T bar 19 supported by angled braces 20 with side brace attach fittings 15 are shown. The pliable no-slip ribbing 21 is seen affixed to the frontal surface of T bar 19 and adjustment holes 17 allow repositioning of the adjustable nailer 16 illustrated in FIG. 8 at A, B, and C. The pliable ribbing 21 is best seen in FIG. 9 at B, and at C, the T bar and walkway support structure is illustrated in a plan view from the top. Hole 22 is available for walk positioning if required. In FIG. 10, the safety bracket 27 is illustrated from the edge at A and in a side view at B. The safety bar holder 28 is also shown at A and B in FIG. 10 and in use at FIG. 5 and FIG. 6.

Figure 11:
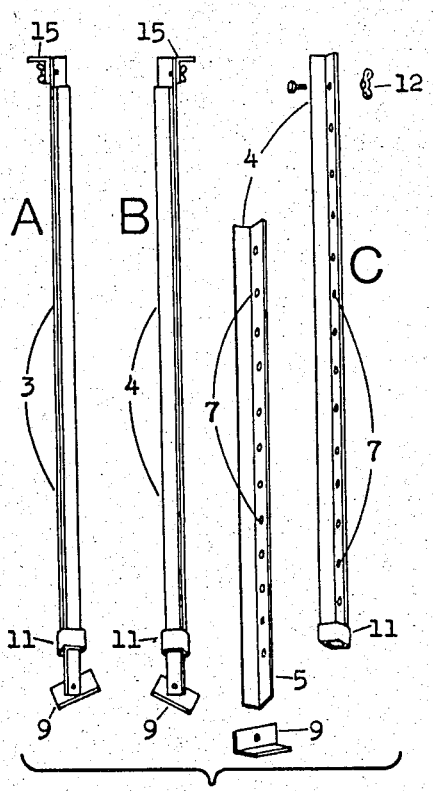
FIG. 11 shows the adjustible side braces at A and B. The parts of one are drawn separated at C, and the angled iron brace leveler foot is positioned below the lower fitting brace section.
Figure 12:
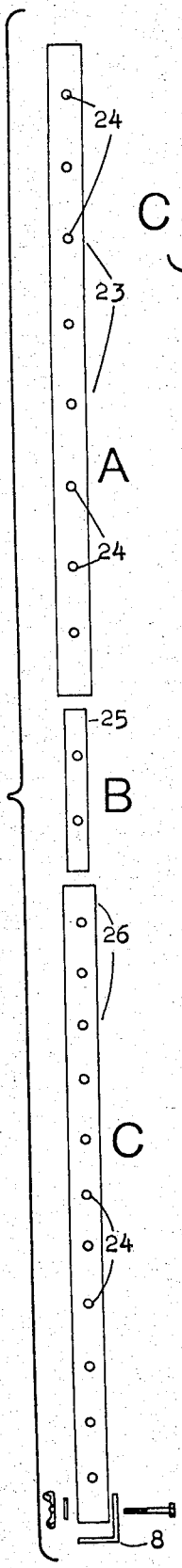
FIG. 12 shows the main leg extension sleeves and supporting insert. The first extension A can be fitted to the main leg by insert B and for additional height, extension leg C can be added to extension leg A by a second insert B.
Figure 13:
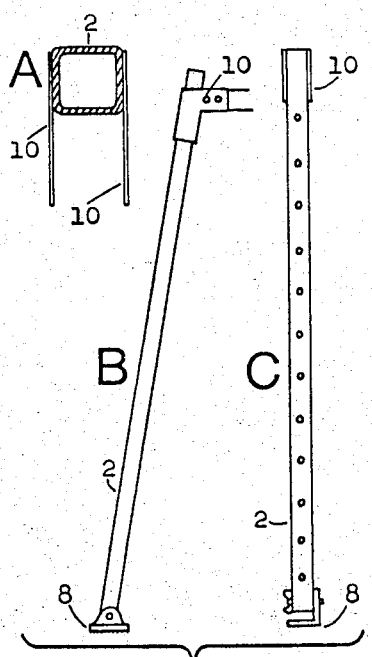
FIG. 13 illustrates the structure of the main leg at A, shows the main support leg in a side view at B, and in a edge view at C.

FIGS. 11, 12, and 13 show illustrations and the parts thereto of the side leg braces 3 and 4, the manin support leg extensions 23, 25, and 26; and the manin support leg 2 with the main leg attach bracket 10.

Figure 5:
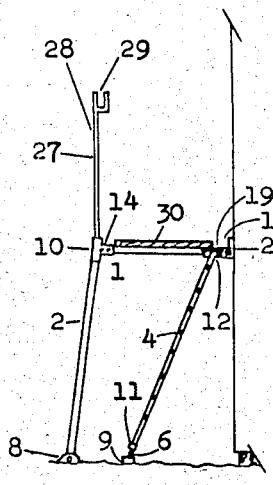
FIG. 5 is a side view of the scaffolding in use illustrating the angled front leg, the adjustable side braces, and the walk contact surface positioned against a wall. The safety bracket holding a 2×4 is illustrated.
Figure 6:
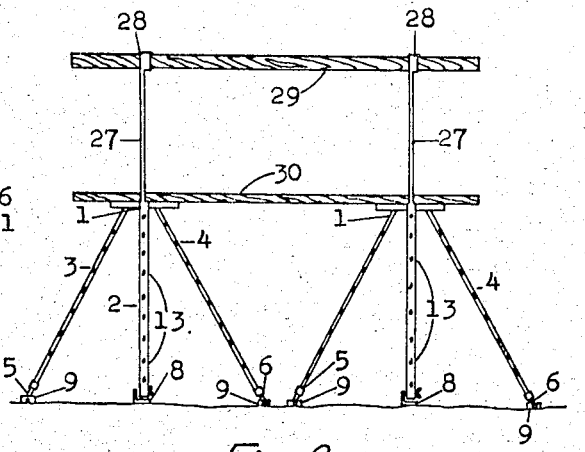
FIG. 6 illustrates two units of the scaffolding in use supporting a plank walkway. Two brackets hold a 2×4 safety bar and angled side braces to prevent lateral movement are shown.
Figure 7:
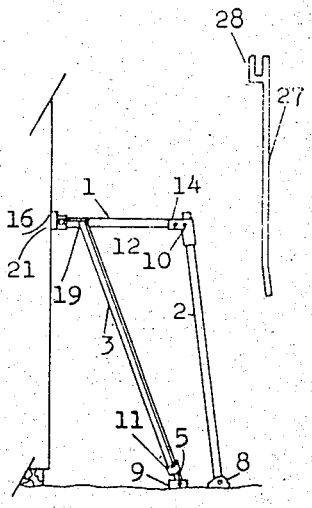
FIG. 7 shows an opposite side view of the scaffolding positioned against a wall. The safety bracket is removed so the angled end stop can be seen.

For transportation purposes, the assemblage as shown in FIGS. 1, 2, 3, and 4 can be easily unbolted by removal of bolt-wing nuts of the type shown as 14. The T bar 19 can be reattached to the main support leg 2 in a downward position and the side braces 3 and 4 can be detached at the brace attach fittings 15. Each scaffolding unit can then be folded into a very compact and portable package for movement from place to place or for storage. Reassembling at the job site is simple and easy with the scaffolding units set up for use as illustrated in FIG. 5 and FIG. 6. Using brackets 27 and holders 28, a safety rail 29 can be positioned sufficiently high above raised walkway 30 by inserting illustrative 2×4 rail 29 into holders 28 to prevent step-back accidents.

Although I have described the preferred embodiment of my invention with considerable detail in the specification, it is to be understood that certain modifications in the design and structure may be made which do not depart from the scope of the invention as defined in the appended claims.

What I claim as my invention is:

1. A portable scaffolding structure, comprising a. a horizontally positioned, T bar having a horizontally aligned walkway support member affixed thereto, the walkway support member attached removably to a downwardly slanted main support leg, the support leg fitted with an extension and a leveling foot pivotally attached at the ground rest position of said leg;

b. there being two angled side supports fastened by fittings affixed to V braces of the T bar, the two angled side supports adjustable for length and extending to a ground position approximately adjacent the main leg ground contact, each side support fitted with a pivotally attached leveling foot; the side supports adding angular bracing to the T bar and walkway support member;

c. there being a pliable ribbed covering on a wall facing surface of said T bar, and fitted to the top of the T bar, there being d. a laterally adjustable angled nailer for nailing attachment to a wall surface and e. the scaffold having a safety bracket with holding means for a security rail fittable into the top section of the said main support leg, f. the scaffolding units used in pairs or more to provide an adjustable elevated walkway in a leveled position.

2. A portable scaffolding structure as claimed in claim 1, wherein the said main support leg and extension are tubular in form.

3. A portable scaffolding structure as described in claim 1, wherein said side angled adjustible support braces are structured of interfitting right angled metal strips.

4. The portable scaffolding of claim 1, wherein the main leg extension is a telescoping insert having apertures matching adjustment holes in the said main support leg.

5. The portable scaffolding of claim 1, wherein extensions for the main support leg are auxiliary units fitable to the main leg by inserts.

6. The extensions of claim 5, wherein the inserts are fittable as holding means for the extensions.

* * * * *